US005648641A

United States Patent [19]

Guthrie

[11] Patent Number: 5,648,641

[45] Date of Patent: Jul. 15, 1997

[54] ELECTROSTATIC ANIMAL BARRIER FOR ELECTRICAL EQUIPMENT

[76] Inventor: James E. Guthrie, 5105 Sand Rd. SE., Iowa City, Iowa 52240-8220

[21] Appl. No.: 651,033

[22] Filed: May 21, 1996

Related U.S. Application Data

[63] Continuation of Ser. No. 353,645, Dec. 8, 1994, abandoned, which is a continuation of Ser. No. 24,275, Feb. 26, 1993, abandoned.

[51] Int. Cl.[6] ..... H01B 17/00; H01B 17/46

[52] U.S. Cl. ..... 174/139; 174/40 R; 174/140 R; 52/101; 361/232

[58] Field of Search ..... 174/139, 140 R, 174/40 R, 5 R, 135, 140 CR, 141 R, 144; 52/101; 47/23, 24; 361/232; 49/58, 59

[56] References Cited

U.S. PATENT DOCUMENTS

| | | | |
|---|---|---|---|
| 1,766,636 | 6/1930 | Hölzel | 174/139 |
| 2,840,631 | 6/1958 | Marcroft | 174/140 R |
| 3,192,311 | 6/1965 | Weinfurt | 174/139 |
| 4,201,883 | 5/1980 | Shepherd | 174/139 |

FOREIGN PATENT DOCUMENTS

| | | | |
|---|---|---|---|
| 0715160 | 8/1965 | Canada | 174/144 |
| 0905156 | 1/1954 | Germany | 174/144 |
| 0284152 | 1/1928 | United Kingdom | 174/139 |

*Primary Examiner*—Hyung S. Sough
*Attorney, Agent, or Firm*—Henderson & Sturm

[57] ABSTRACT

An electrostatically charged animal barrier for the protection of electrical bushings and other types of electrical equipment which utilizes a plurality of radially extending spokes fabricated from conducting material. These spokes may be secured within the bushing material itself, or may be carried by an annular support of non-conducting material which is removably secured about the longitudinal axis of the bushing. The inner side of the annular support includes a number of small projections to space the support from the bushing so as to provide a passageway for condensation and rainfall. Current flow through the conductor within the bushing creates an electrostatic charge on the spokes sufficient to discourage an animal from attempting to climb around the barrier.

5 Claims, 2 Drawing Sheets

ELECTROSTATIC ANIMAL BARRIER FOR ELECTRICAL EQUIPMENT

This is a continuation of U.S. patent application Ser. No. 08/353,645 filed Dec. 8, 1994, now abandoned, which in turn is a continuation of U.S. patent application Ser. No. 08/024,275 filed Feb. 26, 1993 now abandoned.

TECHNICAL FIELD

This invention relates to animal guards for use on bushings and insulators for high voltage lines such as those used on electrical transformers, circuit breakers, capacitors, and the like.

BACKGROUND ART

Equipment such as transformers, circuit breakers, capacitors, fused cutouts, conductor insulators, underground cable terminators and other equipment utilizing insulators is commonly used in electrical power supply systems. Such equipment is frequently damaged or even destroyed if an animal contacts a ground source and an energized conductor or terminal. This usually causes a power outage with the resultant disruption of service to numerous customers.

Several prior art devices, such as those disclosed in U.S. Pat. Nos. 2,840,631, 3,192,311, and 4,201,883 have attempted to solve this problem by providing physical or electrical barriers to discourage or prevent animals from coming into contact with the equipment. However, the prior art devices do not eliminate tracking or flashover because of inadequate gaps which still results in the destruction of the device and equipment. Also, in none of the prior art devices can installation or removal of the insulator guard take place while the equipment is energized. This results in outage time during installation or removal of the guard.

DISCLOSURE OF THE INVENTION

The present invention discloses an electrostatically charged animal barrier for the protection of electrical bushings and other types of electrical equipment which utilizes a plurality of radially extending spokes fabricated from conducting material. These spokes may be secured within the bushing material itself, or may be carried by an annular support of non-conducting material which is removably secured about the longitudinal axis of the bushing. The inner side of the annular support includes a number of small projections to space the support from the bushing so as to provide a passageway for condensation and rainfall. Current flow through the conductor within the bushing creates an electrostatic charge on the spokes sufficient to discourage an animal from attempting to climb around the barrier.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
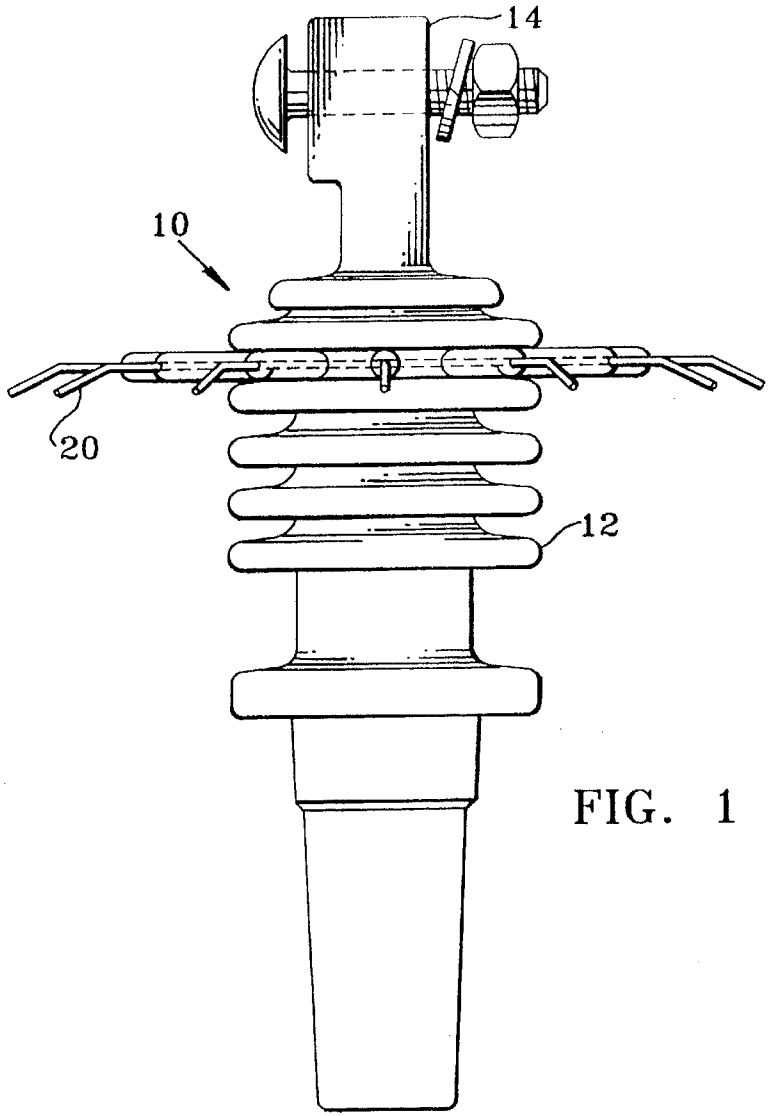
FIG. 1 is a side elevation view of a first embodiment of the invention.
Figure 2:
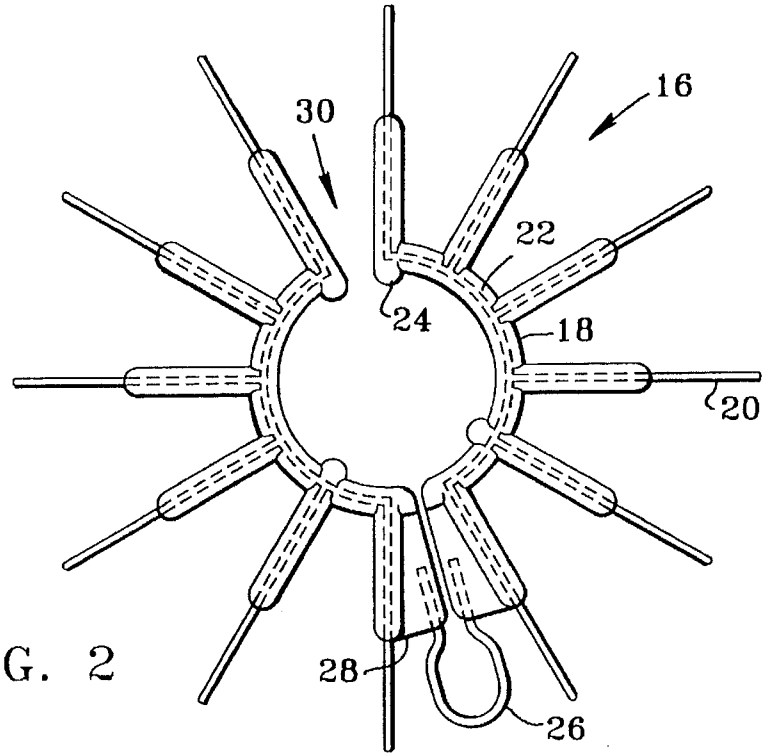
FIG. 2 is a top view of the barrier removed from the terminal bushing.
Figure 3:
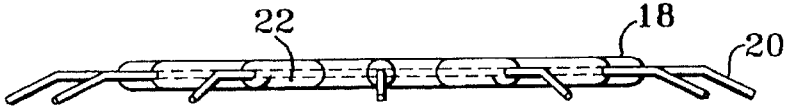
FIG. 3 is a side view of the barrier removed from the terminal bushing.

Referring now to the drawings, wherein like reference numerals designate identical or corresponding parts throughout the several views, a first embodiment of the invention is depicted at 10 in FIG. 1 and comprises an insulated bushing 12 with a terminal 14 disposed at the upper end which is affixed to a conducting stud (not shown) which extends down through the bushing 12 for securement to an electrical transformer or other electrical equipment. Referring also to FIGS. 2 and 3, one embodiment of a barrier 16 is shown, comprised of an annular base 18, fabricated from an insulating material such as rubber, epoxy, silicone, vinyl, or the like, which supports a plurality of spokes 20 extending radially therefrom in a spaced apart relationship. As clearly seen in FIG. 2, the insulating material of the annular base 18 preferably extends outward along each of the spokes 20 for a short distance for increased strength. Extending radially inwardly from the inner side of the annular base 18 are a plurality of short stubs 24, also fabricated from the same insulating material as the base 18. These stubs 24 function to displace the annular base 18 slightly away from the bushing 12 so as to allow drainage of condensation, rainfall, and other moisture buildups.

In the particular embodiment depicted in FIG. 2, the annular base 18 can be seen to be two separate semi-circular sections held together by a spring 26 which extends into flanges 28 of insulating material protruding from an end insulation extension on each section. A small gap 30 is left between the ends of the semi-circular sections opposite the spring 26 to facilitate installing the device onto the bushing 12 and removing it. In a further embodiment, utilizing an insulating material of sufficient resiliency, the annular base 18 is a continuous ring but for gap 30, and the spring 26 is not utilized.

In the particular embodiment depicted in FIG. 2, the spokes 20 extend radially from a conductor 22 enclosed within the insulating material of the annular base 18 as shown by the dashed lines. This gives the device greater strength, but is not required. Other embodiments of the invention have none of the spokes 20 electrically connected or utilize various combinations of the spokes 20 electrically connected, depending on particular electrostatic requirements for the invention. At the present time, it appears that having adjacent pairs of spokes 20 electrically connected within the annular base 18 of insulating material provides the best electrostatic field for warding off animals.

Figure 4:
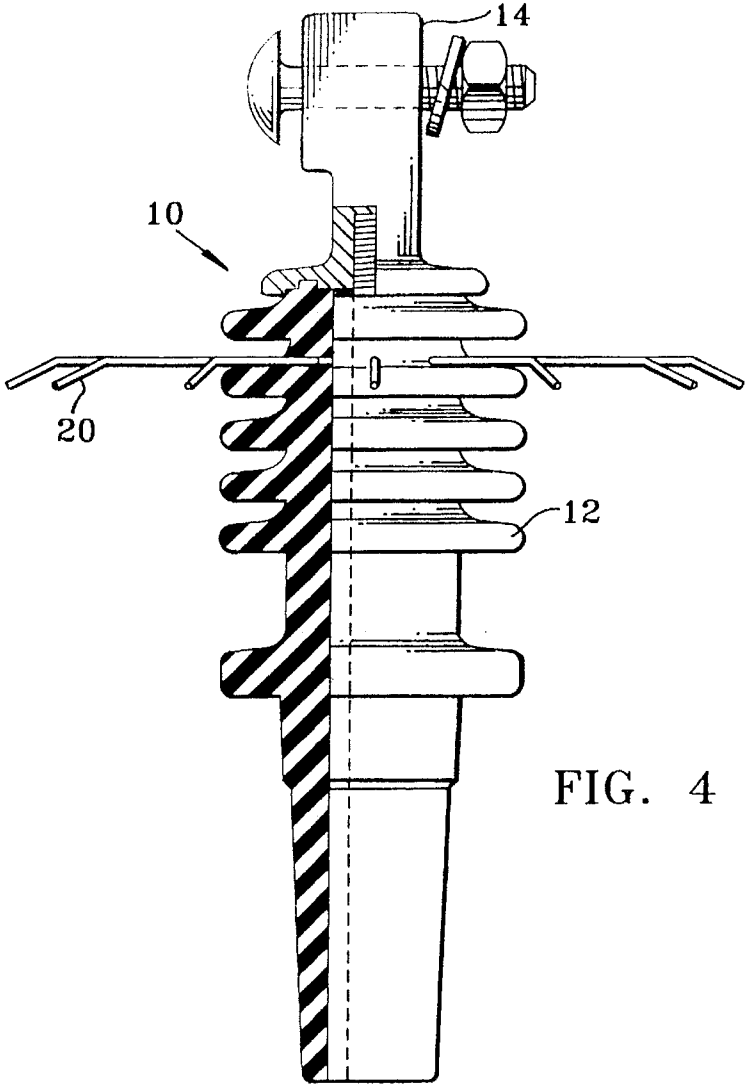
FIG. 4 is a side elevation view of a second embodiment of the invention, in partial section.
Figure 5:
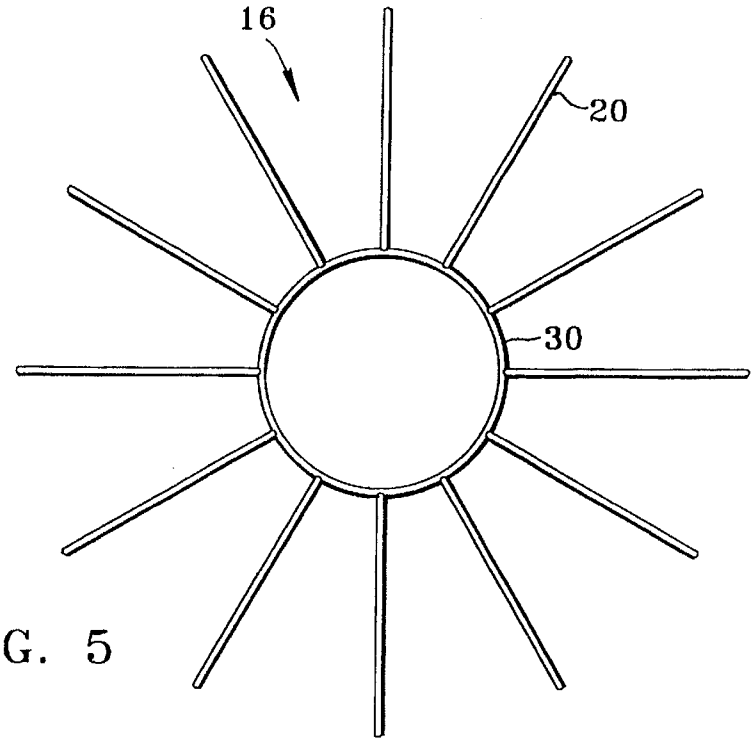
FIG. 5 is a top view of the barrier of a second embodiment.
Figure 6:
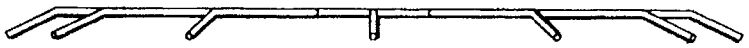
FIG. 6 is a side view of the barrier of a second embodiment.

Referring now to FIGS. 4–6, a further embodiment of the invention is depicted in which the spokes 20 are fabricated within the body of the bushing 12. Although not necessarily required, the spokes 20 could first be welded to a ring 30 for ease of manufacture. As previously noted, various numbers and electrical combinations of spokes 20 are possible and it is not intended to limit or restrict this disclosure to any particular such combination.

Those skilled in the art will recognize that many modifications and variations of the present invention are possible in light of the above teachings. It is therefore to be understood that, within the scope of the appended claims, the invention may be practiced otherwise than as specifically described.

What is claimed is:

1. A physical and electrostatic animal barrier for use on energized electrical insulators and terminal bushings, comprising:

an electrically conducting barrier comprising a generally resilient C-shaped electrostatically chargeable base provided with a plurality of radially extending electrostatically chargeable spokes partially surrounded by an insulating material which also surrounds a portion of the base; wherein said generally resilient C-shaped base includes a pair of generally semi-circular sections operatively connected to one another on one end in a resilient fashion to define an expansible opening dimensioned to receive energized bushings and insulators.

2. The invention as in claim 1 further including: a plurality of insulated inwardly directed radial projections on said base.

3. The invention as in claim 2; wherein, said generally resilient C-shaped base includes:

spring means disposed intermediate the generally semi-circular sections of the base for operatively connecting said sections to one another in a resilient fashion.

4. A physical and electrostatic animal barrier for use on energized electrical insulators and terminal bushings, comprising:

an electrically conducting barrier comprising a generally resilient C-shaped electrostatically chargeable base provided with a plurality of radially extending electrostatically chargeable spokes partially surrounded by an insulating material which also surrounds a portion of the base; wherein said generally resilient C-shaped base includes a pair of generally semi-circular sections operatively connected to one another on one end by a spring element wherein the other end of the sections define an expansible opening dimensioned to receive energized bushings and insulators.

5. The invention as in claim 4 further including: a plurality of insulated inwardly directed radial projections on said base.

* * * * *